US007525786B1

(12) United States Patent
Douglas

(10) Patent No.: US 7,525,786 B1
(45) Date of Patent: Apr. 28, 2009

(54) EXTENDABLE ELECTRONIC IMMOBILIZATION STAFF

(76) Inventor: Stephen C. Douglas, 37577 Newcastle Rd., Murrieta, CA (US) 92563

( * ) Notice: Subject to any disclaimer, the term of this patent is extended or adjusted under 35 U.S.C. 154(b) by 295 days.

(21) Appl. No.: 11/583,518

(22) Filed: Oct. 18, 2006

(51) Int. Cl.
*F41B 15/04* (2006.01)

(52) U.S. Cl. ..... 361/232; 463/47.3; 231/7; 42/1.08

(58) Field of Classification Search ..... 361/232; 463/47.3; 42/1.08; 231/7
See application file for complete search history.

(56) References Cited

U.S. PATENT DOCUMENTS 5,842,601 A * 12/1998 Pierpoint ..... 222/1
6,546,665 B1 * 4/2003 Eldredge et al. ..... 43/17.5
7,100,602 B2 * 9/2006 Cole et al. ..... 128/200.14
7,353,984 B2 * 4/2008 Quail ..... 231/7
7,421,933 B1 * 9/2008 Pearson ..... 89/1.11

* cited by examiner

*Primary Examiner*—Stephen W Jackson
*Assistant Examiner*—Scott Bauer
(74) *Attorney, Agent, or Firm*—Richard D. Clarke

(57) ABSTRACT

An extendable electronic discharge staff will consist of a central sliding member translating within a tubular body member to be positioned by the means of a spring-loaded ball detent. When the central sliding member is positioned, it will be locked in place by the means of a locking nut at the distal end of the tubular body member. A forward adjustable hand-grip will be located and locked into position along the length of the tubular body member to accommodate the size and comfort of the person using the device. By rotating the rear hand grip, the device will be turned on or off, and by sliding the rear handgrip forward or backward a high or low voltage will be delivered to the distal contact end of the central sliding member. On an alternate embodiment having three contact positions, the default center position delivers low voltage while both forward and backward outer positions deliver high voltage. This action gives the operator two different voltage capabilities along with a visible snapping arc to indicate the potential of the device. A sealed cylindrical housing fixed to the rear of the tubular body member will house a removable battery pack and electronic control module. The device is capable of giving a momentary delivery, a prolonged delivery, or several prolonged deliveries and has been designed not to stun an individual unless necessary, giving the unruly individual several warnings in advance.

16 Claims, 5 Drawing Sheets

EXTENDABLE ELECTRONIC IMMOBILIZATION STAFF

FIELD OF THE INVENTION

The present invention relates to an extendable electronic discharge staff used by police officers, army personnel or security personnel to ward off or to stun, through varying degrees of electrical current, individuals in an adverse environment. More specifically, this device keeps a safe, defined distance between the operator and the individual, clearly emphasizing the consequences if contact is made with the device. This device has been designed not to stun an individual unless necessary, giving the unruly individual several warnings in advance. The first warning would be verbal, explaining at a distance the potential dangers. Second would be the snapping arc at the distal end of the device. The third would be a low voltage shock delivered to the individual. If all else fails, the device is capable of delivering a high voltage stunning shock that will incapacitate most people for a short period of time. The device is capable of giving a momentary delivery, a prolonged delivery, or several prolonged deliveries.

BACKGROUND OF THE INVENTION

Staffs have been used as a defense mechanism for centuries, long before handguns were invented. This was clearly illustrated by Friar Tuck in the Robin Hood series. Staffs have been successful as defense weapons because they keep the opponent away from physical contact and the relative size of the user does not make a great deal of difference. Staffs are securely held in both hands with the person using it in a balanced stable position.

This inventor, being a police officer, has found that an officer being in close contact with an individual in an adverse environment can be placed in a position where he may be seriously injured or be responsible for unforeseen injuries to the individual being taken into custody. Many instances have been recorded by television cameras where officers have been overzealous trying to physically subdue uncooperative individuals. Often it is seen where large unruly crowds press directly up against security personnel. In the past, the only way of holding crowds back was physical force. The best way to handle these situations is to remain calm, staying a safe distance and be in complete control of the situation. Getting too close to the individuals in these situations will cause both the security personnel, and the individual they are endeavoring to subdue, to loose control and cause panic. Too many times, misunderstandings have led to great tragedies.

A wide variety of less-lethal weapons are now being developed to control individuals in adverse environments minimizing the need of using lethal weapons such as the guns carried by police officers. A great deal of pressure is being put on police departments to keep their officers from using their handguns. The conventional high voltage self defense devices function by delivering a high voltage pulse between two electrodes spaced apart allowing the current to immobilize an individual when contact is made. These devices are currently manufactured in various forms including the traditional hand-held devices, some with electrodes inches from the hand of the operator to the compressed air models labeled "stun guns" that fire a one-time wire-attached pair of daft like electrodes, and others where the projectile carries the battery and electronic package.

U.S. Pat. No. 6,092,597 of Ming-Chen Lin describes an improved structure of an electric shock device that includes a handle, and a plurality of retractable rod portions. The handle has an interior accommodating therein a high voltage generator and a battery unit. The handle further has a control switch at a lower rim thereof. The retractable rod portions are arranged and assembled in order of size, and equipped with a retractable function by utilizing springs and retaining rods disposed therein. The rod portions are made of insulating materials and respectively provided with parallel positive and negative electrode plates on both sides thereof. The electrode plates nearest to the handle are connected to positive and negative terminals of the high voltage generator so as to supply the rod portions with the required high voltages. The permittivity of dielectrics on the rod portions that have different diameters causes them to be equivalent so that the conductance conditions of the rod portions are the same, and the rod portions can all generate electric arcs.

This patent describes an electric shock device to be held in one hand like a sword where the electrical contact to an individual is made by the side of the device. Although it has a telescoping feature, it does not have the length to keep unruly individuals at a safe distance, and has only one level of shocking voltage capability. It also lacks the ruggedness and durability needed in mass volume crowds where multiple contacts/jabs may be required.

U.S. Pat. No. 6,963,480 of James Byron Eccles describes a high voltage stun device, unique in the sword-like configuration of its fully retractable, yet non-injurious, "blade," and its ability to deliver the pulse along the length of the "blade" as well as at the tip to a target at a distance far beyond arm's length. Stun batons, even retractable ones, have none of the preferred properties satisfied by the invention, including superior length of shocking surface, superior weighting and flexibility of the shocking surface, and simplicity of maintenance and repair. The "blade" of the invention is capable of expanding to a superior length that can keep a subject at a good defensive distance, yet be effective and retracted if he manages to get in close. With a moderation of the centrifugal force applied during blade deployment, the invention can be made to emulate a shorter sword, a long sword, and all lengths between. Further, the balance and dimensions of the device allow for fencing techniques to be utilized, while being portable and concealable unlike a traditional, fixed blade sword.

This patent describes a fragile sword like electric shock device also to be held and operated in one hand. Holding a device like this relies on the strength of the user's wrist alone, with no back up by the other hand. A large person may have no problem with this operation, but not all people required to use these devices may have the strength or agility to use them effectively. It also lacks the ruggedness and durability needed in mass volume crowds where multiple contacts/jabs may be required.

Patent Application Publication No. 2005/0024807 of Milan Cerovic et al. describes embodiments of an electric discharge weapon system and methods of use that are disclosed. In accordance with one embodiment, the weapon system may include a weapon that includes a body portion adapted for discharging a force (such as, for example, an electric discharge or an electric discharge projectile) towards a target, a handgrip coupled to the body portion, a trigger adapted for initiating the discharge of the force, and a display coupled to the body portion.

This patent describes a stun gun type of device that fires a dart like projectile with the battery and electronics incorporated into each projectile. The projectiles are designed to penetrate the skin of the individual. The appearance of a gun like device has the potential of further misunderstandings along with the ability of missing the target or hitting the individual in the eye doing permanent damage. The device also requires reloading to fire a second projectile which takes the officers attention off the individual, and diverts his attention to the reloading operation.

Patent Application Publication No. 2006/0067026 of Dennis R. Kaufman describes a stun gun of one embodiment that includes: a first dart coupled to a tether and positioned to be propelled along a first trajectory, a second dart coupled to a tether and positioned to be propelled along a second trajectory divergent to the first trajectory, and a third dart coupled to a tether and positioned to be propelled along a third trajectory substantially parallel to the first trajectory. The stun gun also includes a power source having opposing charges and an activation circuit. The activation circuit is adapted to selectively connect one of the opposing charges to the first dart and connect the other of the opposing charges to the second and third darts.

This patent describes an other stun gun type of device with dart-like projectiles connected to the device and control circuitry by tethers. This is a single shot device where the tether lines are still connected to the stun gun and can get in the way of any further activity. The only warning capable when using this type of device is verbal and each shot is full voltage.

Patent Application Publication No. 2006/0187610 of Li Su describes a cartridge for an electrical immobilization weapon for optimized effectiveness and accuracy, comprising: a housing means for accommodating first and second projectiles adapted for being spaced within a targeted portion, having a length of at least from 5 inches to 25 inches of a human body and for transmitting the electrical energy to the target; connecting means having at least one such length for interconnecting the first and second projectiles and available outside the housing means for retaining the projectiles within the said length in between thereof; means including the housing means for separating the first and second projectiles for immediately achieving a said length in between after leaving the housing means; means secured to the housing means for propelling the projectiles from the housing means for reaching the targeted portion; and means for coupling the projectiles to the electrical energy of the weapon's power supply.

This patent describes another stun gun type of device or electrical immobilization weapon with dart-like projectiles that are connected to the device and control circuitry by tethers. This is another single shot device where the tether lines are still connected to the stun gun and can get in the way of any further activity.

Thus, there is a continuing need to improve the position of security personnel when dealing with one or more people in an adverse environment. Consequently, there exists a need for an apparatus which will put those personnel at a reasonable distance from unruly people. None of the foregoing prior art teaches or suggests the particular unique features of the extendable electronic discharge staff and thus clarifies the need for further improvements in the equipment used by police officers, army personnel or security personnel.

In this respect, before explaining at least one embodiment of the extendable electronic discharge staff in detail it is to be understood that the device is not limited in its application to the details of construction and to the arrangement of the components set forth in the following description or illustrated in the drawings. The extendable electronic discharge staff is capable of other embodiments and of being practiced and carried out in various ways. In addition, it is to be understood that the phraseology and terminology employed herein are for the purpose of description and should not be regarded as limiting.

SUMMARY OF THE INVENTION

The invention is advantageous in that it has the unique capability of keeping unruly individuals at a safe distance from police officers, army personnel or security personnel using the device.

The principal advantage of the extendable electronic discharge staff is its length and extendibility.

Another advantage of the extendable electronic discharge staff is that it is held in both hands of the operator.

Another advantage of the extendable electronic discharge staff is that it can be used as effectively by a small person as it can be by a large person.

Another advantage of the extendable electronic discharge staff is that the forward handgrip is adjustable to the size and comfort of the operator.

Another advantage of the extendable electronic discharge staff is that it can easily be turned on and off and activated without moving either hand from the holding position, allowing the operator to keep visual contact with the situation.

Another advantage of the extendable electronic discharge staff is that it gives an individual several degrees of warning before the operator has to use the high voltage stunning capability of the device.

Another advantage of the extendable electronic discharge staff is that it is off until the operator twists the throttle handgrip to the low voltage position, or in the alternate embodiment where the operator slides the spring-loaded rear handgrip forward or backward activating the high voltage settings.

Another advantage of the extendable electronic discharge staff is that the operator can give a momentary activation or prolonged activation of the device in the high or low voltage positions by just sliding the spring-loaded rear handgrip forward or backward, or in the alternate embodiment, twisting the throttle handgrip for low voltage and sliding fore or aft for high voltage.

Another advantage of the device is that it is large enough to hold a bigger battery pack giving a longer range of use ability.

Another advantage is that the length of the device can easily be adjustable to two or more places and securely locked into that position.

In addition, another advantage is that if an unruly person grabs or touches the device along the extended fore portion, they would close the circuit and get either a low voltage shock when the handgrip is slid to the rear or a high voltage incapacitating shock when the handgrip is slid forward. In the alternate embodiment, when the throttle grip is twisted on, it is automatically set at low voltage, thereby rendering an immediate shock upon grabbing or touching the extended fore portion, or an incapacitating high voltage shock when the handgrip is slid either fore or aft.

A further advantage is that the device has an easily replaced rechargeable battery or the battery may be recharged within the device.

And yet a further advantage of this device is to add a new and unique item to the area of less-lethal weapons minimizing the need of physical contact or the use of more lethal weapons.

These together with other objects of the extendable electronic discharge staff, along with the various features of novelty, which characterize the device, are pointed out with particularity in the claims annexed to and forming a part of this disclosure. For a better understanding of the extendable electronic discharge staff, its operating advantages and the specific objects attained by its uses, reference should be made to the accompanying drawings and descriptive matter in which there are illustrated the preferred embodiments of the device. There has thus been outlined, rather broadly, the more important features of the extendable electronic discharge staff in order that the detailed description thereof that follows may be better understood, and in order that the present contribution to the art may be better appreciated. There are additional features of the device that will be described hereinafter and which will form the subject matter of the claims appended hereto.

The preferred embodiment of the extendable electronic discharge staff will consist of a central sliding member translating within a tubular body member to be positioned by the means of a spring-loaded ball detent locating within two or more orifices along the surface of the tubular body member. When the central sliding member is positioned, it will be locked in place by the means of a locking nut at the distal end of the tubular body member. A forward adjustable handgrip will be located and locked into position along the length of the tubular body member to accommodate the size and comfort of the person using the device. By rotating the rear handgrip the device will be turned off or on to the low voltage position, or by sliding the rear handgrip forward or backward, which is spring-loaded to center, a high voltage will be delivered to the distal contact end of the central sliding member, giving the operator two different voltage capabilities along with a visible snapping arc to indicate the potential of the device. A sealed cylindrical housing fixed to the rear of the tubular body member will house the battery pack and electronic control module. The battery pack can easily be replaced by removing the cap that will screw on the back of the cylindrical housing.

With respect to the above description then, it is to be realized that the optimum dimensional relationships for the parts of the device, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present description. Therefore, the foregoing is considered as illustrative only of the principles of the device. Further, since numerous modifications and changes will readily occur to those skilled in the art, it is not desired to limit the device to the exact construction and operation shown and described, and accordingly, all suitable modifications and equivalents may be resorted to, falling within the scope of this disclosure.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
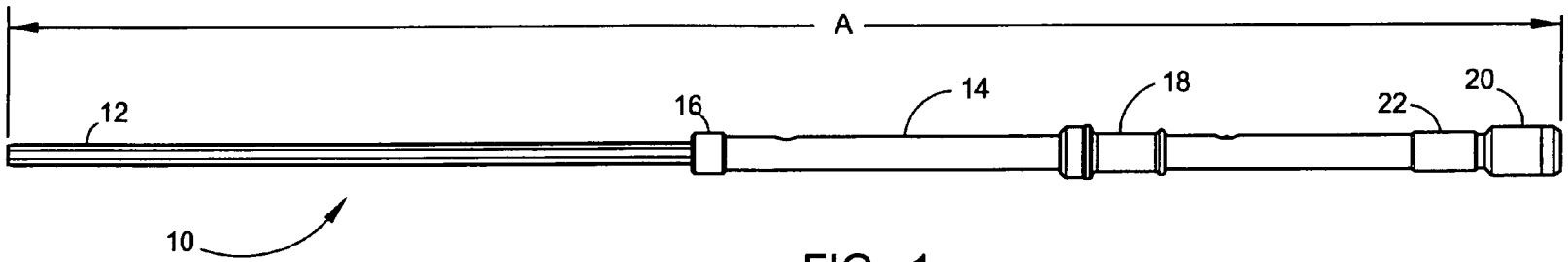
FIG. 1 depicts a side view of the extendable electronic discharge staff in the maximum extended configuration.

Referring now to the drawings, wherein similar parts of the extendable electronic discharge staff 10 are identified by like reference numerals, there is seen in FIG. 1 a side view of the extendable electronic discharge staff 10 with the central sliding member assembly 12 in the maximum extended configuration. The tubular body member 14 comprises the body of the device with the position locking mechanism 16 at the forward distal end. An adjustable forward handgrip assembly 18 may be located in various positions along the tubular body member 14 and tightened into position. At the rear of the extendable electronic discharge staff 10 is the electronics compartment 20 adjacent to the spring-loaded rear handgrip assembly 22. In the preferred embodiment, the extendable electronic discharge staff 10 would be a maximum length of seven feet nine inches indicated as the A dimension. It is also anticipated that the average size of the device would be from about 3.5 feet compacted to about 6 feet in length fully extended.

Figure 2:
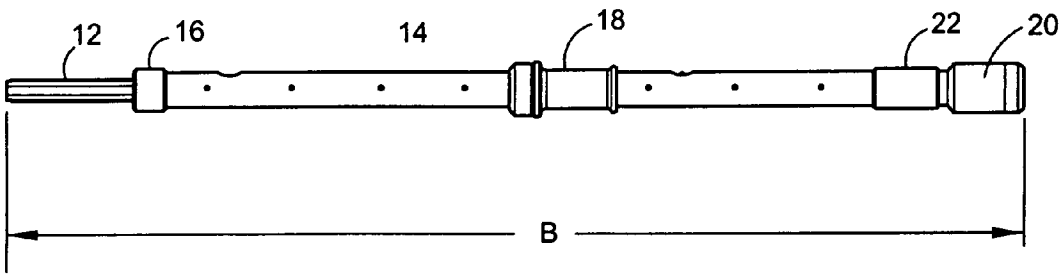
FIG. 2 depicts a side view of the extendable electronic discharge staff in the retracted configuration.

FIG. 2 depicts a side view of the extendable electronic discharge staff 10 in the retracted configuration of four feet six inches indicated as the B dimension. It must be understood at this time that the extended length A and the retracted length B may vary depending upon the requirements of the operators and the operating conditions which the device is used, and all varying extended and retracted lengths along with the adjustable lengths of the extendable electronic discharge staff 10 will be covered within the scope of this patent.

Figure 3:
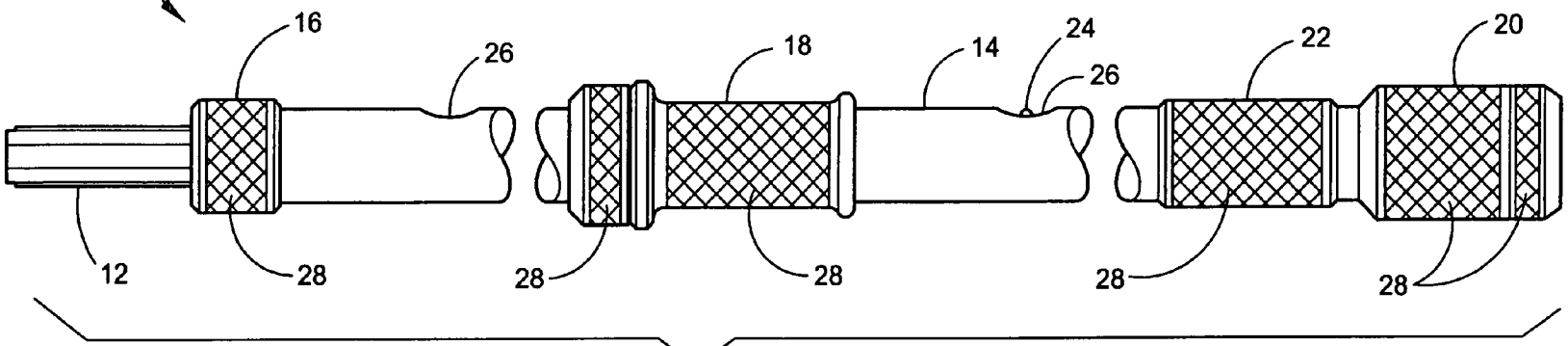
FIG. 3 depicts an enlarged side view of the extendable electronic discharge staff in the retracted position.

FIG. 3 depicts an enlarged side view of the extendable electronic discharge staff 10 in the retracted position indicating the location of the spring-loaded ball detent 24 and two of the detent cavities 26. Spring-loaded ball detent 24 will provide a means to locate the central sliding member 12 within the tubular body member 14 after which the position locking mechanism 16 provides a means for securely locking the components together. The detent cavities allow a means for the forward handgrip assembly 18 to slide over the spring-loaded ball detent 24 to be repositioned. Although only two detent cavities 26 are shown, any number may be incorporated to adjust the overall length of the extendable electronic discharge staff 10. The crosshatched areas 28 on the components of the extendable electronic discharge staff 10 represent non-slip, knurled surfaces.

Figure 4:
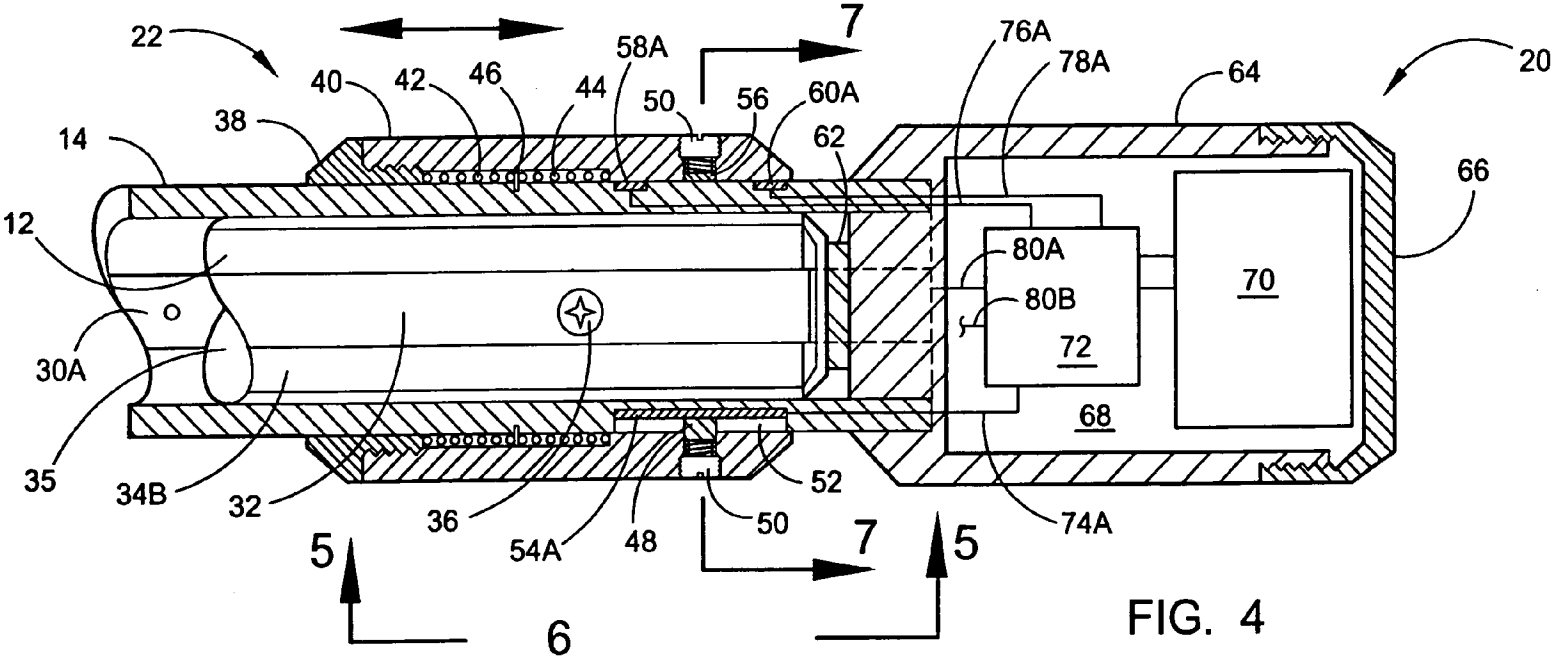
FIG. 4 depicts a cross section side view of the spring-loaded rear handgrip and electronics compartment.

Referring now to FIG. 4 where a cross-section side view of the spring-loaded rear handgrip assembly 22 and electronics compartment 20 shows one of the opposing internal conductive rails 30A attached to the inside of the tubular body member 14. The conductive rails mate with the channels 32A and 32B in the conductive bars 34A and 34B attached to the central sliding member assembly core 35 by the mounting screws 36. The spring-loaded rear handgrip assembly 22 consists of an rear handgrip end cap 38 threaded into the rear handgrip body 40 where a forward actuating spring 42 and backward actuating spring 44 are separated by the means of a snap ring 46. The springs 42 and 44 provide a means for the spring-loaded rear handgrip assembly 22 to move forward and backward, returning to a central location by the means of the opposing spring compression. This action also supplies a unique means for the handgrip assembly 22 to freely rotate. At the back of the handgrip assembly 22 at the lower section, a spring-loaded conductive terminal 48 shown held in place by a pressure screw 50 within a T-slot 52 against two conductive on/off control bars 54A and 54B. The rotation of the spring-loaded handgrip 22 supplies the means by which the device can be turned from off to on. The "on" position is set at low voltage on the alternate embodiment (see below).

At the top rear of the handgrip assembly 22 is a spring-loaded high/low voltage contact plate 56 held against the outer surface of the tubular body member 14 by the means of another pressure screw 50. When the handgrip assembly 22 is rotated into the on position it can be moved forward with the high/low voltage contact plate 56 making contact with the two high voltage contact buttons 58A and 58B or backward making contact with the two low voltage contact buttons 60A and 60B. These sliding positions are the means to open the circuit for either the high voltage or low voltage activation. Shown between the central sliding member assembly 12 and the electronic compartment 20 is a rubber cushion pad 62.

The cylindrical housing 64 of the electronics compartment 20 is permanently attached to the back end of the tubular body member 14 with a threaded end cap 66 sealing the internal compartment 68. Within the internal compartment 68 is the rechargeable battery pack 70 connected to the electronics control module 72 where two on/off wires 74A and 74B are attached to the two conductive on/off control bars 54A and 54B. Four additional wires also attach to the electronics control module 72, wires 76A and 76B connect to the high voltage contact buttons 58A and 58B, and wires 78A and 78B connected to the low voltage contact buttons 60A and 60B. Another two wires 80A and 80B connect the conductive rails 30A and 30B to the electronics control module 72. As shown later in FIG. 8B (see below), contacts 58A and 58B, and 61A and 61B will connect to the high voltage contacts, while contacts 59A and 59B at the central "on" position will connect to the low voltage contacts when the device is immediately turned on.

By rotating the spring-loaded rear handgrip assembly 22, the device can be turned on or off. When the device is turned on, sliding of the handgrip assembly backward produces a low voltage charge delivered to the forward distal end of the central sliding member assembly 12 through the conductive rails 30A and 30B within the tubular body member 14, into the sliding rail conductive bars 34A and 34B to the distal contact end 82. Sliding the spring-loaded rear handgrip assembly 22 forward in the on position delivers a high voltage charge to the distal contact end 82 of the sliding member assembly 12 in the same manner. On the alternate embodiment, as shown in FIG. 8B below, rotating the spring-loaded rear handgrip assembly 22 turns the device on and it is automatically and immediately set at low voltage, while sliding of the handgrip assembly 22 backward or forward produces a high voltage charge and an accompanying arcing spark at the distal end of the central sliding member assembly 12.

Figure 5:
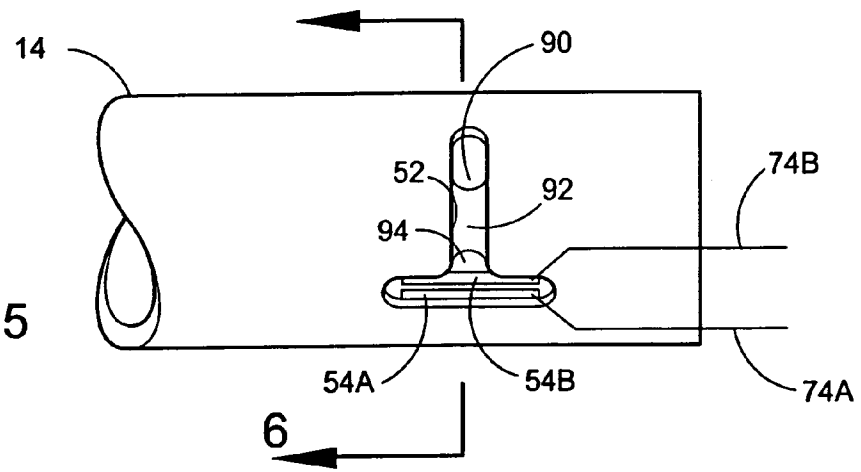
FIG. 5 depicts a side view of the rear distal end of the tubular body member of the extendable electronic discharge staff.

FIG. 5 depicts a side view of the rear distal end of the tubular body member 14 of the extendable electronic discharge staff 10 illustrating the location of the T-slot 52. The depth of the T-slot 52 varies from the depressed off section 90 and carries over a raised bridge section 92 to a second depressed on section 94. With the spring-loaded conductive terminal 48 located within the rear handgrip assembly 22 traversing over the bridge section 92 in the T-slot 52, it provides a means for the device to quickly snap between the off position to the on position.

Figure 6:
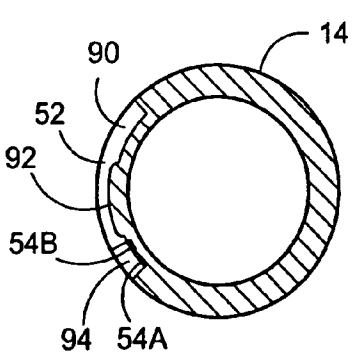
FIG. 6 depicts a cross section of the tubular body member through the control T-slot.

FIG. 6 depicts a cross section of the tubular body member through the control T-slot 52 clarifying the depth of the on and off sections 90 and 94 along with the location of the bridge section 92 between them.

Figure 7:
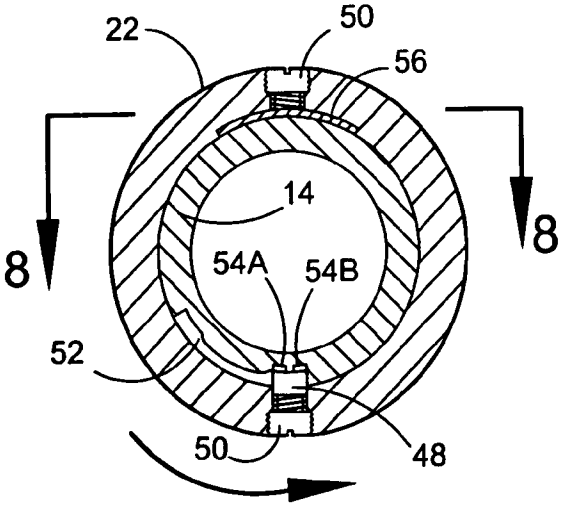
FIG. 7 depicts a cross section of the spring-loaded rear handgrip and the tubular body member.

FIG. 7 depicts a cross section of the spring-loaded rear handgrip assembly 22 and the tubular body member 14 intersecting the pressure screw 50 pressing against the high/low voltage contact plate 56 adjacent to the tubular body member 14. By sliding the rear handgrip assembly 22 either forward or backward, the high/low voltage contact plate 56 provides a unique means of opening either the high voltage or low voltage connections within the device, should the operator need to push against or pull away from unruly persons. The T-slot 52 and the pressure screw 50 pressing against the conductive terminal 48 that are making contact with the on/off contact bars 54A and 54B are additionally displayed.

Figure 8A:
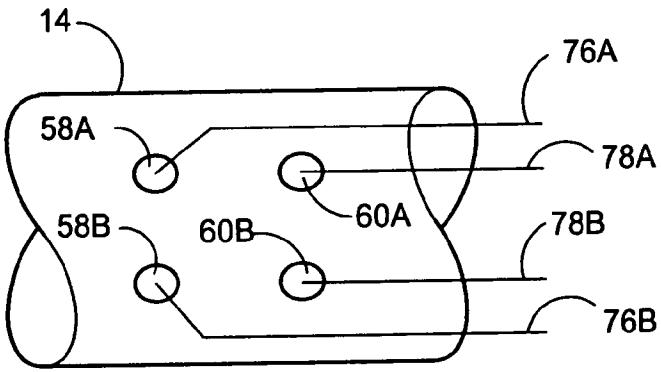
FIG. 8A depicts a side view of the tubular body member illustrating the high voltage contact buttons for forward, or high voltage setting, and the low voltage contact buttons for backward, or low voltage setting, sliding configuration of the rear throttle handgrip.
Figure 8B:
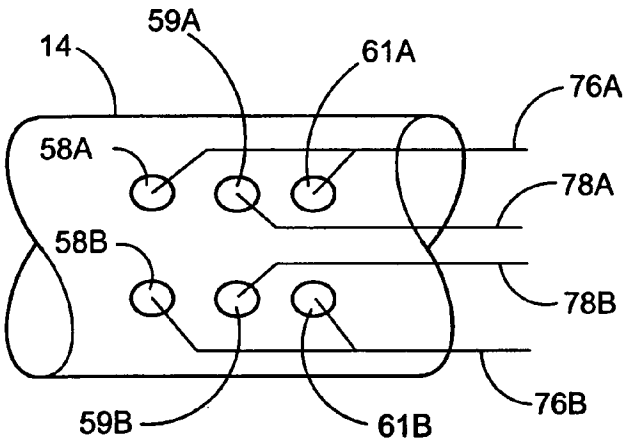
FIG. 8B depicts a side view of the tubular body member illustrating the central contact buttons for the center low voltage position and the outer fore and aft high voltage contact buttons for forward and backward slides of the rear throttle handgrip.

FIG. 8A depicts a side view of the tubular body member 14 illustrating the locations of the high voltage contact buttons 58A and 58B and low voltage contact buttons 60A and 60B. When twisted into the "on" position, immediately the low voltage contact buttons 60A and 60B are engaged with low voltage wires 78A and 78B. Upon sliding the handgrip forward the high voltage buttons 58A and 58B are engaged with high voltage wires 76A and 76B.

FIG. 8B depicts a side view of the tubular body member 14 illustrating the same locations of the outer high voltage contact buttons 58A and 58B and now outer high voltage contact buttons 61A and 61B (where low voltage buttons 60A and 60B used to be positioned), but now also includes the centrally located low voltage buttons 59A and 59B. When twisted into the "on" position, immediately the low voltage contact buttons 59A and 59B are engaged with low voltage wires 78A and 78B. Upon sliding the handgrip forward the high voltage buttons 58A and 58B are engaged with high voltage wires 76A and 76B. Upon sliding the handgrip backward the high voltage buttons 61A and 61B are engaged with high voltage wires 76A and 76B. Therefore, on this alternate embodiment of the device, as shown here in FIG. 8B, turning on the device sets it automatically and immediately in the low voltage position, while sliding the rear handgrip assembly either forward or backward will engage the high voltage contact plate, which provides a unique means of opening the high voltage connections within the device. Again, when the device is switched to the high voltage position an arcing spark is present letting the operator and others know the device is set on "high."

Figure 9:
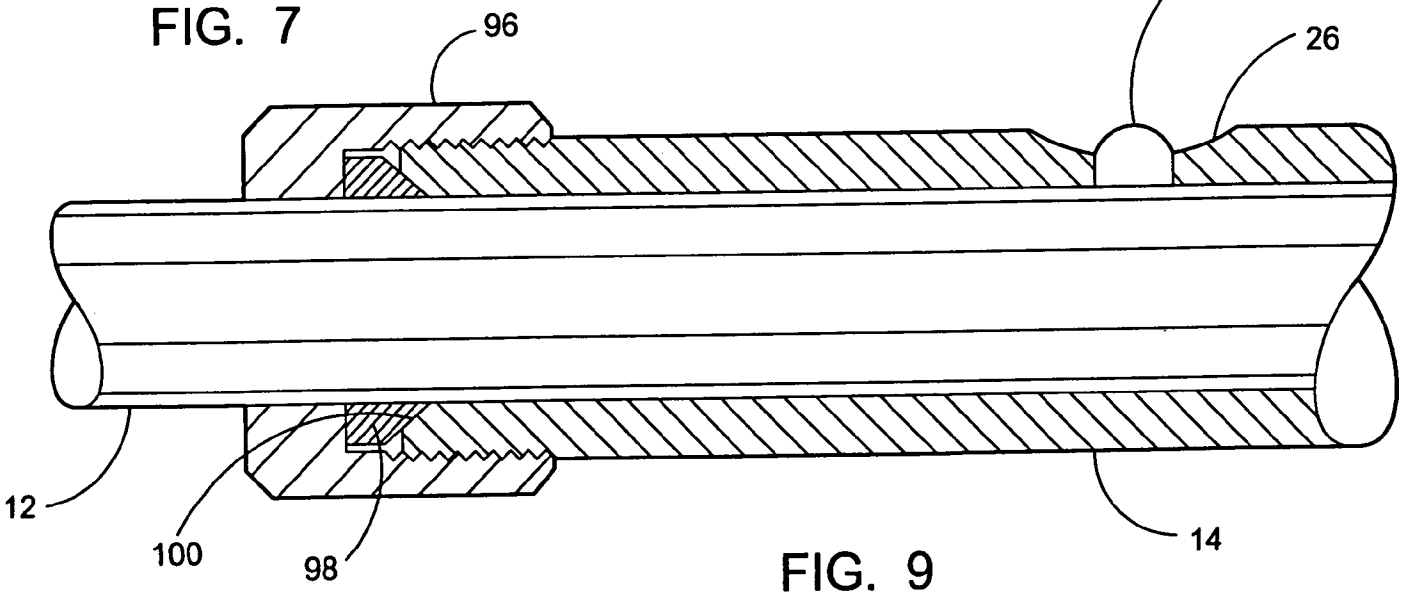
FIG. 9 depicts a cross section of the forward distal end of the tubular body member and the position locking mechanism.

FIG. 9 depicts a cross section of the forward distal end of the tubular body member 14 and the position locking mechanism 96. When the central sliding member assembly 12 is positioned by the means of the spring-loaded ball detent 24, the position locking mechanism 96 will be tightened to press the tapered locking ring 98 into the tapered end 100 of the tubular body member 14, locking the tubular body member 14 and the sliding member assembly 12 together.

Figure 10:
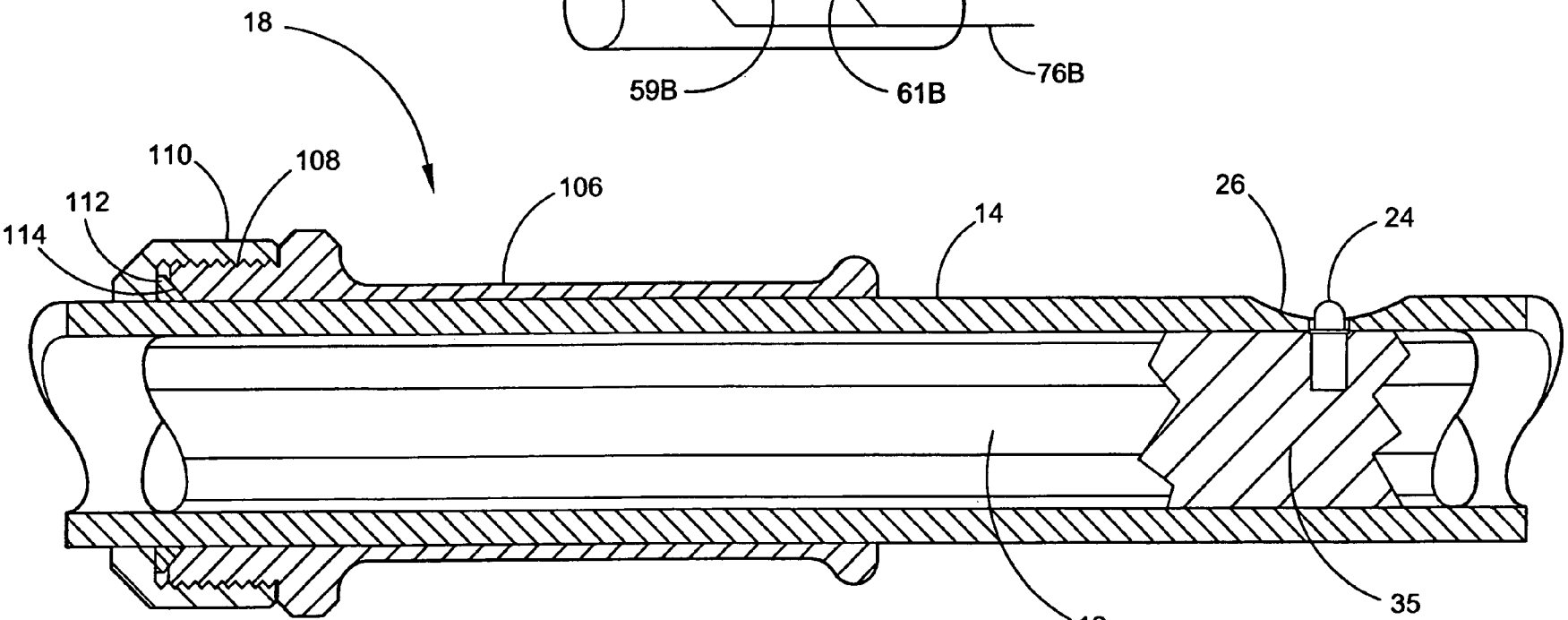
FIG. 10 depicts a cross section of the mid portion of the tubular body member and the adjustable forward hand grip.

FIG. 10 depicts a cross section of the mid portion of the tubular body member 14 and the adjustable forward handgrip assembly 18 with the handle portion 106 having a threaded end 108 mating with a threaded nut portion 110. When the threaded nut portion 110 is tightened against the handle portion 106, a tapered locking ring 112 is forced into the mating tapered end 114 of the handle portion 106.

Figure 11:
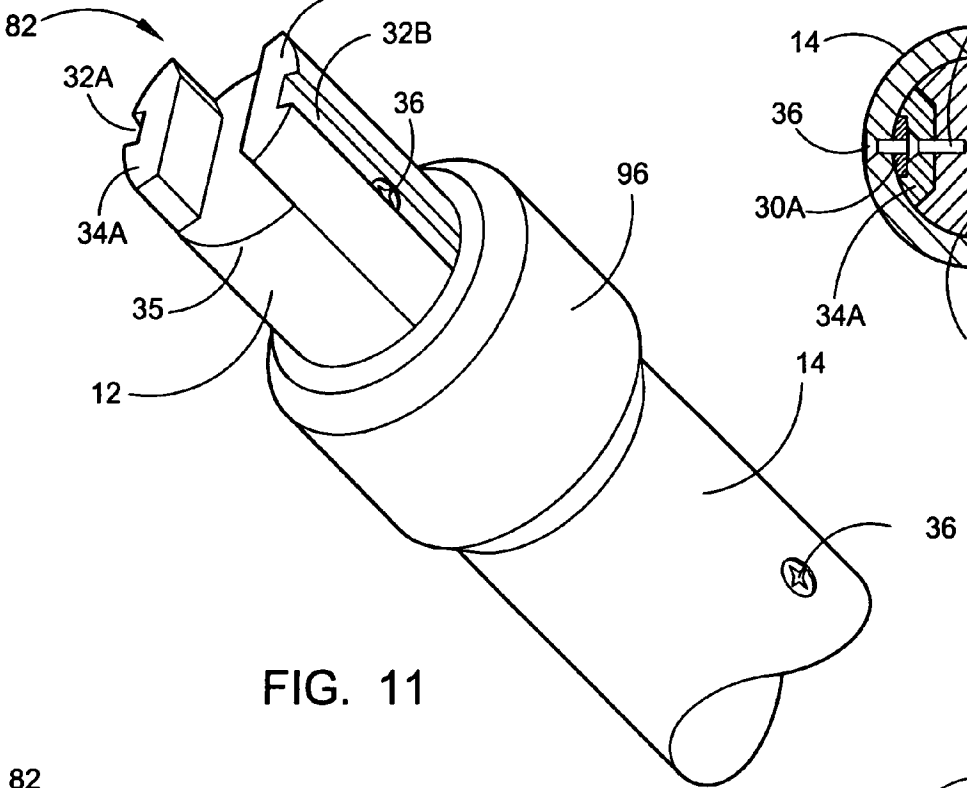
FIG. 11 depicts a perspective view of the contact end of the sliding central member along with the locking mechanism on the tubular body member.

FIG. 11 depicts a perspective view of the contact end 82 of the sliding central member 12 along with the locking mechanism 96 on the tubular body member 14. The sliding member conductive bars 34A and 34B are shown extended past the sliding member core 35 where the spark gap 116 is created.

Figure 12:
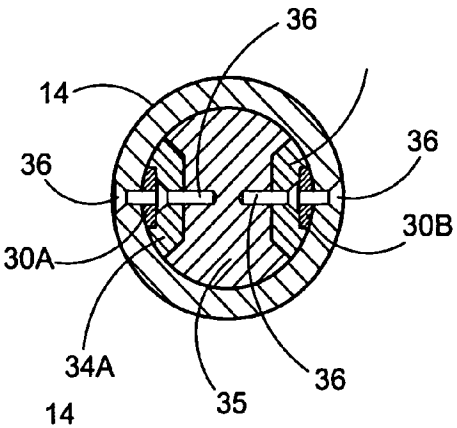
FIG. 12 depicts a cross section view through the tubular body member and the central sliding member.

FIG. 12 depicts a cross section view through the tubular body member 14 and the central sliding member 12 illustrating the locations of the conductive bars 34A and 34B attached to the sliding member core 35 by the means of the mounting screws 36. The conductive rails 30A and 30B are shown attached to the tubular body member 14 by additional mounting screws 36.

Figure 13:
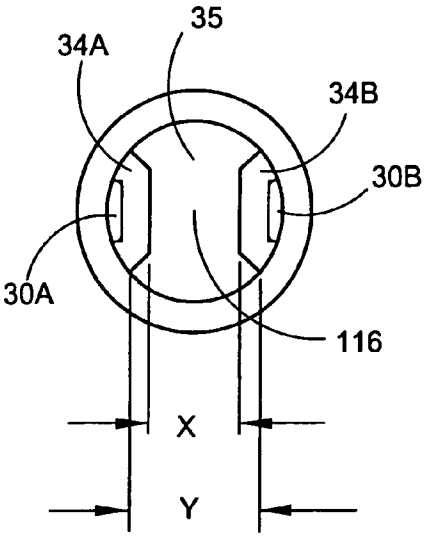
FIG. 13 depicts an end view of the extendable electronic discharge staff indicating the gap between the conductive bars.

FIG. 13 depicts an end view of the extendable electronic discharge staff 10 indicating the spark gap 116 between the conductive bars 34A and 34B. The spacing X between the conductive bar 34A and the conductive bar 34B is the narrowest location between the conductive bars producing a snapping arc when the high voltage system is activated. When the low voltage system is activated there is not enough voltage to produce a snapping arc, but the low voltage system will adequately shock an individual when it comes into contact without producing the severe stunning reaction. The spacing Y between the edges of the conductive bars 34A and 34B are angled away from each other insuring that the snapping arc is concentrated at the sliding member distal contact end 82. It is anticipated that the low voltage setting will deliver about 20,000 volts and the high voltage setting will deliver about 50,000 volts when contacted.

Figure 14:
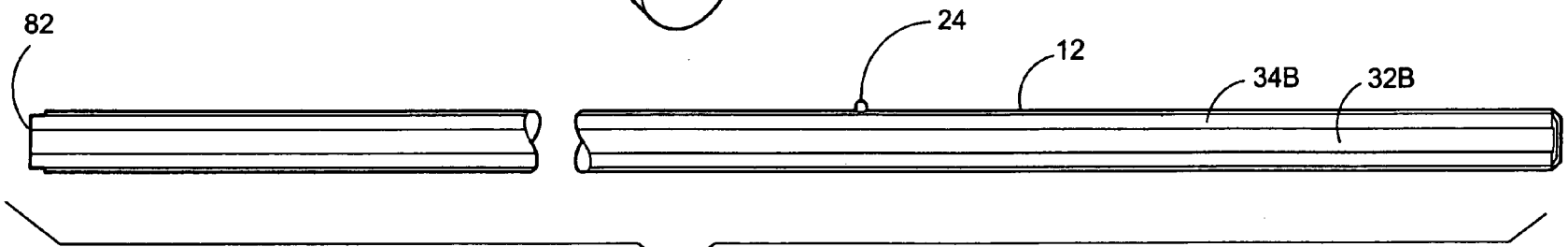
FIG. 14 depicts a side view of the sliding central member.

FIG. 14 depicts a side view of the central sliding member assembly 12 indicating that the conductive bars 34A and 34B extend its full length.

The extendable electronic discharge staff 10 shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described may be employed for providing an extendable electronic discharge staff 10 in accordance with the spirit of this invention, and such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. An extendable electronic immobilization staff comprising:

(a) a tubular body member having a position locking mechanism, an electronics housing compartment including a power source, a rear handgrip assembly and a forward handgrip assembly thereon;

(b) a central sliding member assembly having two or more conductive rails in electrical communication with said electronics compartment, separated by a non-conductive core, said rails located parallel to the central axis of said central sliding member and terminating on a distal end with a protruded portion; and (c) an on/off switch integrated into said rear handgrip assembly having an on position and an off position wherein said on position includes a low voltage position and a high voltage position wherein said on/off switch integrated into said rear handgrip assembly rotationally twists to move from the off position to the on position and further wherein said on/off switch integrated into said rear handgrip assembly slides forward or backward to adjust from high voltage to low voltage settings;

whereby said central sliding member assembly slides into and out from said tubular body member to a desired length, locked into place using said position locking mechanism, and said conductive rails are provided with electrical power for discharge to immobilize a person thereby contacted.

2. The extendable electronic immobilization staff, according to claim 1, wherein said electronics housing compartment including a power source houses a rechargeable battery pack and an electronics control module for supplying and controlling electrical power applied to the immobilization staff.

3. The extendable electronic immobilization staff, according to claim 1, wherein said on/off switch integrated into said rear handgrip assembly has a sliding two position voltage configuration, namely, a low voltage position and a high voltage position.

4. The extendable electronic immobilization staff, according to claim 1, wherein said on/off switch integrated into said rear handgrip assembly has a sliding three position voltage configuration, namely, a centrally located low voltage position and two outer high voltage positions.

5. The extendable electronic immobilization staff, according to claim 1, wherein said low voltage setting delivers about 20,000 volts, and said high voltage setting delivers about 50,000 volts of immobilizing electricity.

6. The extendable electronic immobilization staff, according to claim 1, wherein said central sliding member is lockably extendable from about 3 to 4 feet in length to about 6 to 7 feet in length, and locks securely at every length in between.

7. The extendable electronic immobilization staff, according to claim 1, wherein said position locking mechanism, said electronics housing compartment, said rear handgrip assembly and said forward handgrip assembly, further include a cross-hatched surface for secure gripping.

8. The extendable electronic immobilization staff, according to claim 1, wherein said one or more conductive rails further comprise two or more conductive bars having a distal end and which protrude at their distal end to form a arc gap between said bars which when set in the high voltage position produce a arcing spark across said gap.

9. A method for making an extendable electronic immobilization staff, comprising the steps of:

(a) providing a tubular body member having a position locking mechanism, an electronics housing compartment including a power source, a rear handgrip assembly and a forward handgrip assembly thereon;

(b) providing a central sliding member assembly having two or more conductive rails in electrical communication with said electronics compartment, separated by a non-conductive core, said rails located parallel to the central axis of said central sliding member and terminating on a distal end with a protruded portion; and (c) providing an on/off switch integrated into said rear handgrip assembly having an on position and an off position wherein said on position includes a low voltage position and a high voltage position wherein said step of providing an on/off switch integrated into said rear handgrip assembly further includes the step of providing an on/off switch integrated into said rear handgrip assembly which rotationally twists to move from the off position to the on position and further wherein said step of providing an on/off switch further includes providing an on/off switch integrated into said rear handgrip assembly which slides forward or backward to adjust from high voltage to low voltage settings;

whereby said central sliding member assembly slides into and out from said tubular body member to a desired length, locked into place using said position locking mechanism, and said conductive rails are provided with electrical power for discharge to immobilize a person thereby contacted.

10. The method for making an extendable electronic immobilization staff, according to claim 9, wherein said step of providing an electronics housing compartment including a power source further includes the steps of providing a rechargeable battery pack and providing an electronics control module for supplying and controlling electrical power applied to the immobilization staff.

11. The method for making an extendable electronic immobilization staff, according to claim 9, wherein said step of providing an on/off switch integrated into said rear handgrip assembly further comprises the step of providing said switch having a forward and rearward sliding, two position voltage configuration, namely, a low voltage position and a high voltage position.

12. The method for making an extendable electronic immobilization staff, according to claim 9, wherein said step of providing an on/off switch integrated into said rear handgrip assembly further comprises the step of providing said switch having a forward and rearward sliding, three position voltage configuration, namely, a centrally located low voltage position and two outer forward and rearward high voltage positions.

13. The method for making an extendable electronic immobilization staff, according to claim 9, wherein said step of wherein said step of providing an on/off switch integrated into said rear handgrip assembly having an on position and an off position wherein said on position includes a low voltage position and a high voltage position further wherein said low voltage setting delivers about 20,000 volts, and said high voltage setting delivers about 50,000 volts of immobilizing electricity.

14. The method for making an extendable electronic immobilization staff, according to claim 9, wherein said step of providing a central sliding member assembly having two or more conductive rails in electrical communication with said electronics compartment, separated by a non-conductive core, said rails located parallel to the central axis of said central sliding member, further includes the step of providing a device wherein said central sliding member is lockably extendable from about 3 to 4 feet in length to about 6 to 7 feet in length, and locks securely at every length in between.

15. The method for making an extendable electronic immobilization staff, according to claim 9, wherein said step of providing a tubular body member having a position locking mechanism, an electronics housing compartment including a power source, a rear handgrip assembly and a forward handgrip assembly thereon, further includes the step of providing same wherein said position locking mechanism, said electronics housing compartment, said rear handgrip assembly and said forward handgrip assembly, further include a cross-hatched surface for secure gripping.

16. The method for making an extendable electronic immobilization staff, according to claim 9, wherein said step of providing two or more conductive rails further includes the step of providing two or more conductive rails wherein said two or more conductive rails further comprise one or more conductive bars having a distal end and which protrude at their distal end to form a arc gap between said bars which when set in the high voltage position produce a arcing spark across said gap.

* * * * *